US005663610A

United States Patent [19]

Inoue et al.

[11] Patent Number: 5,663,610

[45] Date of Patent: Sep. 2, 1997

[54] CATHODE RAY TUBE THAT MINIMIZES MISLANDING OF ELECTRON BEAMS DUE TO THERMAL EXPANSION AND VIBRATION

[75] Inventors: Masatsugu Inoue, Kumagaya; Satoshi Tsunokawa, Fukaya; Takashi Murai, Fukaya; Norio Shimizu, Fukaya, all of Japan

[73] Assignee: Kabushiki Kaisha Toshiba, Kawasaki, Japan

[21] Appl. No.: 469,924

[22] Filed: Jun. 6, 1995

[30] Foreign Application Priority Data

Aug. 9, 1994 [JP] Japan ..... 6-187273

[51] Int. Cl.[6] ..... H01J 29/86; H01J 31/00

[52] U.S. Cl. ..... 313/461; 313/477 R; 313/408; 220/2.1 A

[58] Field of Search ..... 313/461, 477 R, 313/408; 220/2.1 R, 2.3 A, 2.1 A; 348/805

[56] References Cited

U.S. PATENT DOCUMENTS

| | | | |
|---|---|---|---|
| 4,535,907 | 8/1985 | Tokita et al. | 220/2.1 A |
| 4,570,101 | 2/1986 | Campbell | 313/477 R X |
| 4,777,401 | 10/1988 | Hosokoshi et al. | 313/477 R X |
| 4,881,004 | 11/1989 | Inoue et al. | 313/477 R X |
| 4,985,658 | 1/1991 | Canevazzi | 220/2.1 A X |
| 5,107,999 | 4/1992 | Canevazzi | 220/2.1 A |
| 5,151,627 | 9/1992 | Van Nes et al. | 313/477 R |
| 5,495,140 | 2/1996 | Fujiwara et al. | 220/2.1 A X |

FOREIGN PATENT DOCUMENTS

| | | |
|---|---|---|
| 61-88427 | 5/1986 | Japan . |
| 61-163539 | 7/1986 | Japan . |

*Primary Examiner*—Ashok Patel

*Attorney, Agent, or Firm*—Cushman Darby & Cushman, IP Group of Pillsbury Madison & Sutro, LLP

[57] ABSTRACT

When an outer surface of an effective portion 20 of a panel 20 is substantially spherical, a diagonal axis of the effective portion, a long axial effective diameter, land a short axial effective diameter are Sd, Sh, and Sv, the panel is shaped to satisfy the relationship, $Dp/Sd<0.05$, $V<H<D$, $2V<Dp<2H$ where Dp an amount of drop at an end of the effective diameter of the diagonal axis, H an amount of drop at the end of the effective diameter of the long axis, V an amount of drop at the end of the effective diameter of the short axis, the relationship, $Ah/Sh<A/Sv$ where Ah a distance in the long axial direction of a thicker region on the long axis and Av a distance in the short axial direction of the thicker region on the short axis, wherein, in the thicker region, the panel has a thickness larger than the average thickness Ta of the effective portion, and the relationship between a maximum thickness T max and a minimum T min, $(Tmax-Ta)>(Ta-Tmin)$ or $|T\ max-Ta|>|T\ min-Ta|$.

2 Claims, 5 Drawing Sheets

CATHODE RAY TUBE THAT MINIMIZES MISLANDING OF ELECTRON BEAMS DUE TO THERMAL EXPANSION AND VIBRATION

BACKGROUND OF THE INVENTION

1. Field of the Invention

The present invention relates to a color cathode ray tube, and more particularly to a color cathode ray tube, wherein a thickness of an effective surface of a panel is changed, which can reduce mislanding caused by thermal expansion of a shadow mask, vibration, and impact.

2. Description of the Related Art

Generally, in a color cathode ray tube, a shadow mask is provided opposite a fluorescent screen, which comprises three color fluorescent layers. Then, three electron beams emitted from an electron gun are selected by the shadow mask to be introduced into the three color fluorescent layers, thereby displaying a color image on the fluorescent screen.

FIGS. 1A and 1B show a structure of the main parts of a cathode ray tube. Normally, the color cathode ray tube comprises a panel 2, having a substantially rectangular effective region, whose inner and outer portion are curved. A fluorescent screen 3 having three color fluorescent layers is formed on the curved inner surface of the effective surface 1. A shadow mask 4 comprises a mask body 5 and a mask frame 6 whose shape is substantially rectangular. The mask body 5 has a substantially rectangular effective surface having apertures through which electron beams pass are formed in a curved portion so as to correspond to the inner surface of the panel 2. The mask frame 6 is attached to a peripheral portion of the mask body 5. The shadow mask 4 is supported by the inner side of the panel by inserting a stud pin 8 formed in the panel 2 into an elastic support 7 attached to the mask frame 6.

FIGS. 1A, 1B and FIG. 3 show the structure in which the belt-like elastic support 7 is attached to the central portion of each side of the mask frame 6 to support the shadow mask 4. However, there may be provided a structure in which a wedge-shaped elastic support is attached to each diagonal portion of the mask frame 6 to support the shadow mask.

In the above-structured color cathode ray tube, in order to display an image having no degradation of color purity on the fluorescent screen, it is required that three electron beams, which are passed through the respective apertures of the shadow mask, be correctly landed onto the three color fluorescent layers constituting the fluorescent screen 3, respectively. In order to improve the color purity, a positional relationship between the panel 2 and the shadow mask 4, particularly a distance (value q) between the inner surface of the panel 2 and the effective surface of the shadow mask 4, must be kept to have a predetermined allowable range.

However, the mask body 5 of the normal shadow mask 4 is formed of a thin carbon steel plate, and the amount of electron beams which reaches the fluorescent screen 3 through the apertures formed in the effective surface is ⅓ of the amount of electron beams emitted from the electron gun. Most of the electron beams collide against the shadow mask. As a result, the shadow mask 4 is heated and thermally expanded, and particularly, the curved shaped mask body 5 having a thin plate thickness is expanded in three directions of the fluorescent screen 3 causing doming. If the amount of expansion due to the doming exceeds the allowable range of value q, mislanding of the electron beams onto the three color fluorescent layers is caused, resulting in degradation of color purity is generated. The degree of the degradation of color purity, which is generated by the thermal expansion of the shadow mask, is different depending on the amount of flow of the electron beams, the size of the image pattern, and display duration of the image pattern.

Regarding the mislanding generated by the thermal expansion of the shadow mask 4, particularly, after a long period of time when the mask body 5 is heated at the initial stage when the operation of the color cathode tube is started, a temperature of the mask body 5 is transmitted to the mask frame 6 to obtain a thermal equivalence state, in other words, mislanding, which is generated for a period of time (about 30 minutes) until the temperature of the mask body 5 and that of the mask frame 6 are substantially the same, Japanese Patent Application KOKAI Publication No. 44-3547 discloses as follows.

A bimetal element is provided between the mask frame 6 and the elastic support 7 for supporting the shadow mask 4, thereby an effective correction can be performed. However, in a case where a high luminance image is locally displayed for a relatively short period time, local expansion is generated. Due to this, mislanding generated by such the local expansion cannot be corrected by the provision of the bimetal element therebetween.

Regarding the mislanding generated by the thermal expansion of the shadow mask 4, a rectangular pattern is generated on the fluorescent screen by a signal generator. Then, the shape and position of the rectangular pattern are variously changed to measure the degree of the mislanding. As a result, as shown in FIG. 2A, in a case where a rectangular pattern **10*a* having a large current and high luminance is generated in substantially the whole area of the fluorescent screen 3, the degree of the mislanding is small. However, as shown in PIG. 2B, if an elongated rectangular pattern 10*b* having the large current and high luminance is generated close to the center from the right end or the left end of the fluorescent screen 3** and extends along a vertical axis, i.e., Y-axis, the largest degree of the mislanding is generated.

The above can be easily understood from the following explanation.

First, the cathode ray tube is generally designed such that an average anode current to be added to the cathode ray tube, that is, a current flowing in an anode, does not exceed a fixed value in the entire screen, the amount of the beam current colliding against the shadow mask per unit area in the case where rectangular pattern **10*a*** having a high luminance is generated as shown in FIG. 2A is smaller than the case of FIG. 2B, and the rise of the temperature of the shadow mask is relatively low.

Secondly, regarding the pattern having a local high luminance, as shown in the elongated rectangular pattern **10*b* of FIG. 2B, even if the shadow mask is thermally expanded, in the case where the local high luminance pattern is generated in the central portion of the fluorescent screen 3, the mislanding is not easily generated since a deflection angle of the electron beam is small. However, the extent that the thermal expansion of the shadow mask appearing as mislanding increases as the portion where the pattern is generated is moved from the center to the right and left ends. However, in the case where the pattern is generated at the right and left ends of the screen 3, since the mask body 5 is fixed by the mask frame, the doming caused by the thermal expansion becomes small. In the end, the largest mislanding is generated in the case that the pattern having a high luminance is generated in the portion close to the center from the right and the left ends of the screen 3**.

FIG. 3 shows mislanding in a case where the high luminance pattern is generated at the portion close to the center from the right and left ends of the screen 3. In this case, the shadow mask 4 is supported by inserting the stud pin 8 formed in the panel 2 into the elastic support 7 attached to the mask frame 6. The effective surface of the mask body 5, on which a large number of apertures are arranged, is opposed to the fluorescent screen 3 formed in the inner surface of the panel 2, and the shadow mask 4, which is shown by a solid line, is used as a shadow mask, which is placed at a normal position. When the shadow mask is placed at the position shown by the solid line, an electron beam 13, which is passed through one aperture 12 positioned at slightly central portion from the right and left ends of the shadow mask 4, is landed onto a correctly corresponding fluorescent layer 14. However, if the high luminance image is displayed by the electron beams having the large current passing in the vicinity of the aperture 12, the portion in the vicinity of the aperture 12 is locally thermally expanded as shown by a one-dot broken line, an electron beam 13*a* passing through the aperture 12*a* displaced by the thermal expansion is not landed onto the predetermined fluorescent layers 14.

Particularly, the latest color cathode ray tube whose effective portion of the panel is flattened has been mainly used, and the effective surface of the shadow mask of the mask body has been also flattened in accordance with the flatted effective portion of the panel. Due to this, such a flattened shadow mask is easily deformed by the thermal expansion causer by collision of the electron beams, and the mislanding is largely generated.

Regarding the color cathode ray tube whose effective portion of the panel is flattened, Japanese Patent Application KOKAI Publications Nos. 61-163539 and 61-88427 disclose a structure in which the shape of the shadow mask is changed to control the mislanding. However, in the color cathode ray tube in which the flattened panel and the flattened shadow mask are combined, a sufficient technical advantage cannot be obtained by the shape of the shadow mask disclosed in the above publications.

In other words, in the latest color cathode ray tube, the panel and the shadow mask are more flattened than those disclosed in the above publications. Due to this, the mislanding caused by the thermal expansion of the shadow mask caused by the collision of the electron beams is large. Therefore, it is required that a mechanism for correcting such a large mislanding be provided. However, there is a problem in that such a large mislanding cannot be sufficiently corrected in the shape of the panel and the shadow mask disclosed in the above publications.

In order to deal with such a problem, Japanese Patent Application KOKAI Publications Nos. 61-163539 and 61-88427 disclose the structure in which the curved surface of the panel is changed to control the mislanding generated by the thermal expansion of the shadow mask.

However, even if the curved surface is redesigned as disclosed in the above publications, no advantage is achieved in a flat panel recently put to practical use and having a substantially spherical surface which reflect a natural ambient image applied onto it from the outside.

Moreover, regarding the color cathode ray tube in which the panel and the effective surface of the shadow mask are flattened, the following problems exist in addition to the thermal expansion of the shadow mask.

More specifically, in the mask body of the shadow mask of the color cathode tube having the flatten effective portion of the panel, there is used a material having a low coefficient of thermal expansion, such as invar, other than the low carbon steel plate used in the shadow mask of the normal color cathode ray tube. The normal mask body of the normal shadow mask is formed to have a predetermined curve surface by press-molding after apertures are formed by photoetching. In the mask body having a high curvature, the mask body is sufficiently plastically deformed at the time of press-molding, so that the necessary mechanical strength can be provided thereto. However, the flatten mask body cannot be sufficiently plastically deformed, and a portion having low mechanical strength is locally formed in the mask body. In other words, in the flatten mask body, an amount of processing at the time of press-molding and an amount of elongation are decreased, and there is generated a portion which cannot be formed in the plastically deforming area and stays in the elastically deforming area. Due to this, the portion having low mechanical strength is locally formed in the mask body. In the shadow mask whose effective surface is substantially rectangular, the portion having low mechanical strength appears in the vicinity of the long axial end close to the central portion from the short side positioned in the long axial direction separating from the center rather than the long side positioned in the direction of the short axis (vertical axis) to the center.

In other words, the area close to the central portion from the short side is far from the center of the shadow mask and not surrounded with a skirt portion unlike the diagonal axial end portion. Due to this, such the area cannot be sufficiently plastically deformed at the time of press-molding, and the processing of the above area stays in the elastically deforming area. As a result, the above area cannot be formed to have a predetermined curved surface, the mechanical strength of the area becomes low, and the area is deformed by impact. Moreover, if vibration or impact is added thereto, there are generated problems in which the area easily resonates, and degradation of color purity occurs.

As mentioned above, in order to display the image having no degradation of color purity on the fluorescent screen of the color cathode ray tube, the distance between the inner surface of the effective portion of the panel and the effective surface of the shadow mask must be kept to a predetermined allowable range. However, most of the electron beams, which are emitted from the electron gun, collide against the shadow mask. The shadow mask 4 is thermally expanded in the direction of the fluorescent screen by the collision of the electron beams. As a result, the electron beams are mislanded onto the three color fluorescent layers, and the purity of color is degraded. There are two mislanding generated by the thermal expansion, that is, mislanding generated for a relatively long period of time until the mask body and the mask frame are in a thermal equivalence state from the initial stage when the operation of the color cathode tube is started, and a local mislanding generated when a high luminance image is locally displayed for a relatively short period time. Among these, in the case of the mislanding generated for a relatively long period time from the initial stage when the operation of the color cathode tube is started, the mislanding can be effectively corrected by providing the bimetal element between the mask frame and the elastic support for supporting the shadow mask 4. However, in the case of the mislanding generated when the high luminance image is locally displayed for a relatively short period time, the mislanding cannot be corrected by providing the bimetal element therebetween, and this local mislanding appears at the largest degree when a high luminance image is generated at a portion closer to the central portion than the right and left ends.

The above mislanding generated by the thermal expansion of the shadow mask is easily generated in the latest color cathode ray tube whose panel and shadow mask are flattened. Due to this, in the color cathode ray tube whose panel and shadow mask are flattened, there has been known a method for changing the shape of the curved surface of the panel and shadow mask, thereby preventing the mislanding. However, in the shape of the well-known shadow mask, the technical advantage cannot be sufficiently obtained. However, even if the curved surface is changed, the sufficient technical advantage cannot be obtained in the flat panel having a substantially spherical surface, which has been recently used in practical such that the natural ambient image is reflected from an outer surface of the panel despite the ambient light applied onto it.

Moreover, in the color cathode ray tube in which the effective surface of the shadow mask is flatten, the mask body cannot be sufficiently plastically deformed at the time of press-molding, so that a portion having low mechanical strength is locally formed in the mask body. The lowest mechanical strength appears in the vicinity of the horizontal axial end close to the central portion from the short side of substantially the rectangular shadow mask. Then, this portion is deformed, or resonates by vibration or impact, and degradation of color purity occurs.

SUMMARY OF THE INVENTION

An object of the present invention is to provide a color cathode ray tube wherein, in a color cathode tube whose effective portion of a panel is flattened, a shape of a curved surface of the effective portion of the panel is appropriately formed, so that thermal expansion, which is caused by collision of electron beams against a shadow mask flattened in accordance with the flattened effective portion of the panel, is controlled to prevent mislanding, and deformation and resonance caused by vibration and impact are not easily generated.

According to the present invention, there is provided a color cathode ray tube apparatus comprising a panel having inner and outer surfaces such that the fluorescent screen is formed on the inner surface, and a substantially rectangular effective portion such that its inner and outer surfaces are formed of curved surfaces, wherein the panel is formed to have a shape so as to satisfy the following relationship when an outer surface of the effective portion is substantially spherical, an effective diameter of a diagonal axis of the outer surface of the effective portion is Sd, an effective diameter of a long axis is Sh, and an effective diameter of a short axis is Sv,:

$$Dp/Sd<0.05$$

$$V<H<D$$

$$2V<Dp<2H$$

where Dp=an amount of drop in a tube axial direction at an end of the effective diameter of the diagonal axis against the center of the outer surface of the effective portion, H=an amount of drop in the tube axial at the end of the effective diameter of the long axis, V=an amount of drop in the tube axial at the end of the effective diameter of the short axis, wherein the panel is formed to have a shape so as to satisfy the following relationship when a thickness of the effective portion differs, depending on the position, by a difference between the outer surface of the effective portion and the inner surface in the curved surface, the following relationship can be satisfied $$(Ah/Sh)<(Av/Sv)$$

where Ah=a distance along the long axis on an area having a thickness larger than the average thickness from a reference position at which the effective portion has an average thickness Ta and Av=a distance along the short axis on the area having a thickness larger than the average thickness from an another reference position at which the effective portion has a average thickness Ta; and wherein the panel is formed to have a Shape so as to satisfy the following relationship when a maximum thickness T max of the effective portion is in the vicinity of the end of the diagonal axis, the following relationship can be satisfied $$(T\ max-Ta)>(Ta-T\ min)$$

or, $$|T\ max-Ta|>|T\ min-Ta|.$$

where T min=a minimum thickness.

Whereby, even in a substantially spherical panel in which the outer surface of the panel can be flattened and can reflect a natural ambient image applied onto it, the radius of curvature of the inner surface of the panel and that of the long axial direction are reduced at the long axis peripheral portion of the effective surface of the shadow mask so that the curved surface, which is mechanically strong, can be formed, and the radius of the short axial direction is reduced at the long axial intermediate portion so that the thermal expansion caused by the collision of the electron beams can be controlled.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENT

An embodiment of the present invention will be explained with reference to the drawings.

Figure 1A:
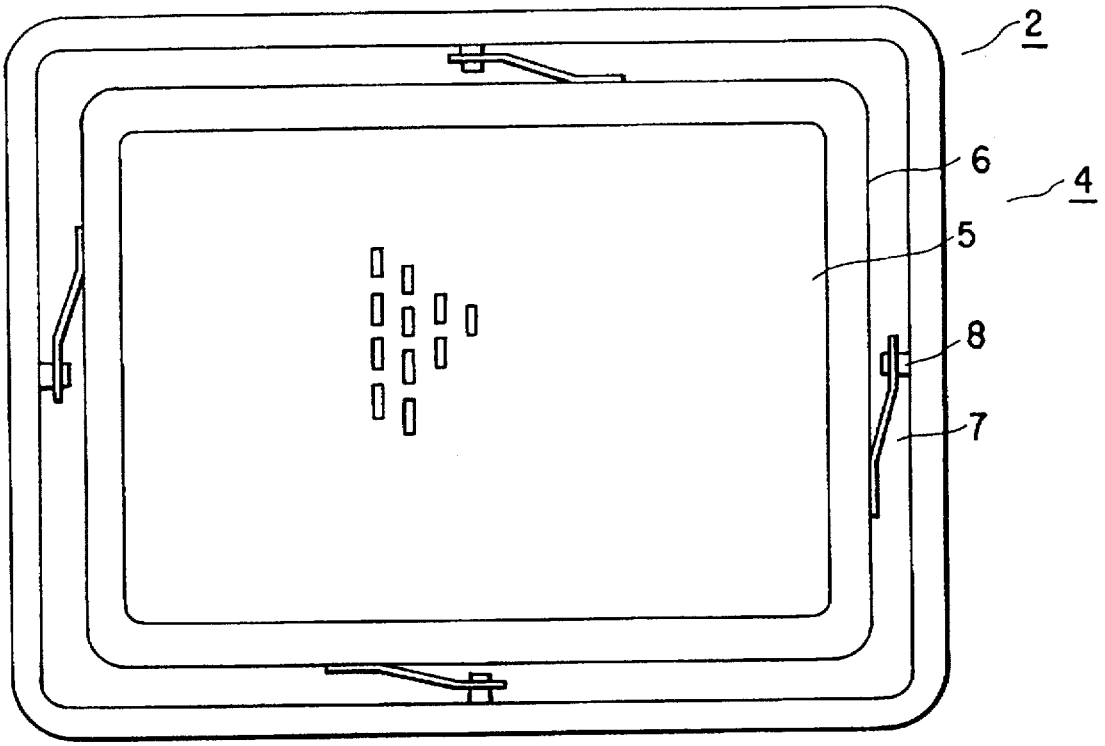
FIG. 1A (PRIOR ART)
FIG. 1A is a plane view schematically showing the structure of a panel of a conventional color cathode ray tube.
Figure 1B:
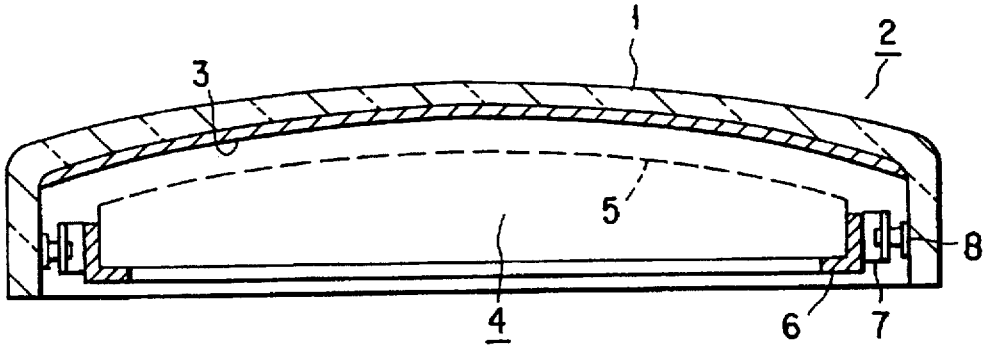
FIG. 1B (PRIOR ART)
FIG. 1B is a cross sectional view of FIG. 1A.
Figure 2A:
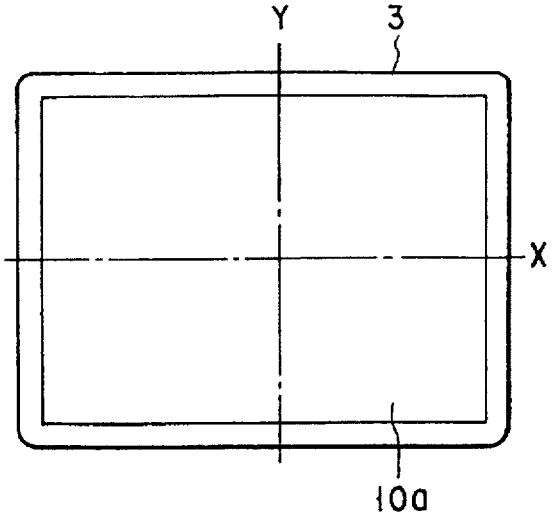
FIG. 2A (PRIOR ART)
FIGS. 2A and 2B are views explaining mislanding generated by thermal expansion of a shadow mask by collision of electron beams, respectively.
Figure 2B:
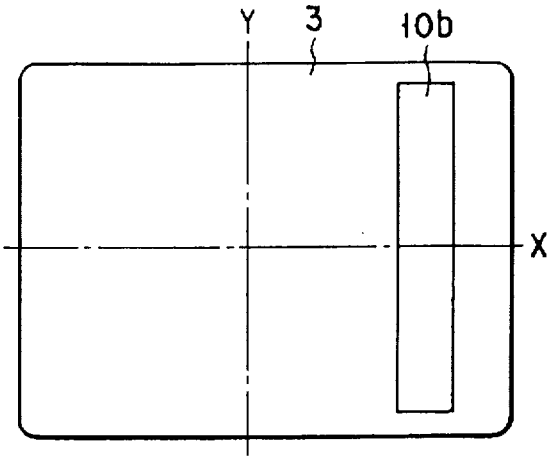
FIG. 2B (PRIOR ART)
Figure 3:
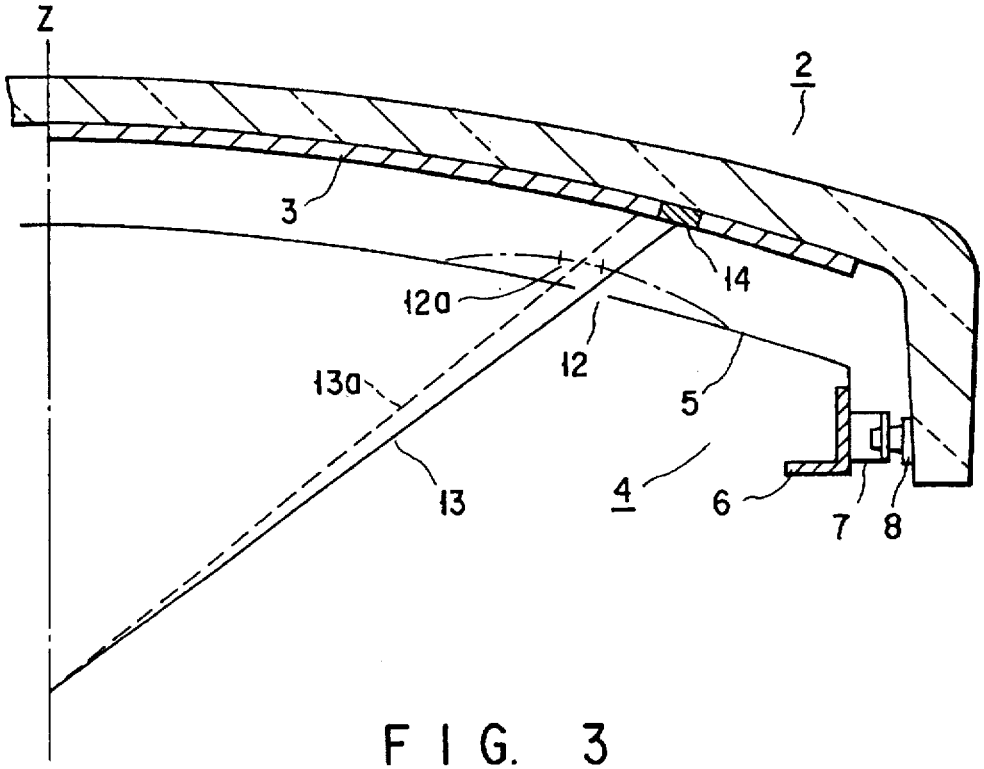
FIG. 3 (PRIOR ART)
FIG. 3 is a cross sectional view explaining mislanding generated by local thermal expansion of the shadow mask by collision of electron beams.
Figure 4A:
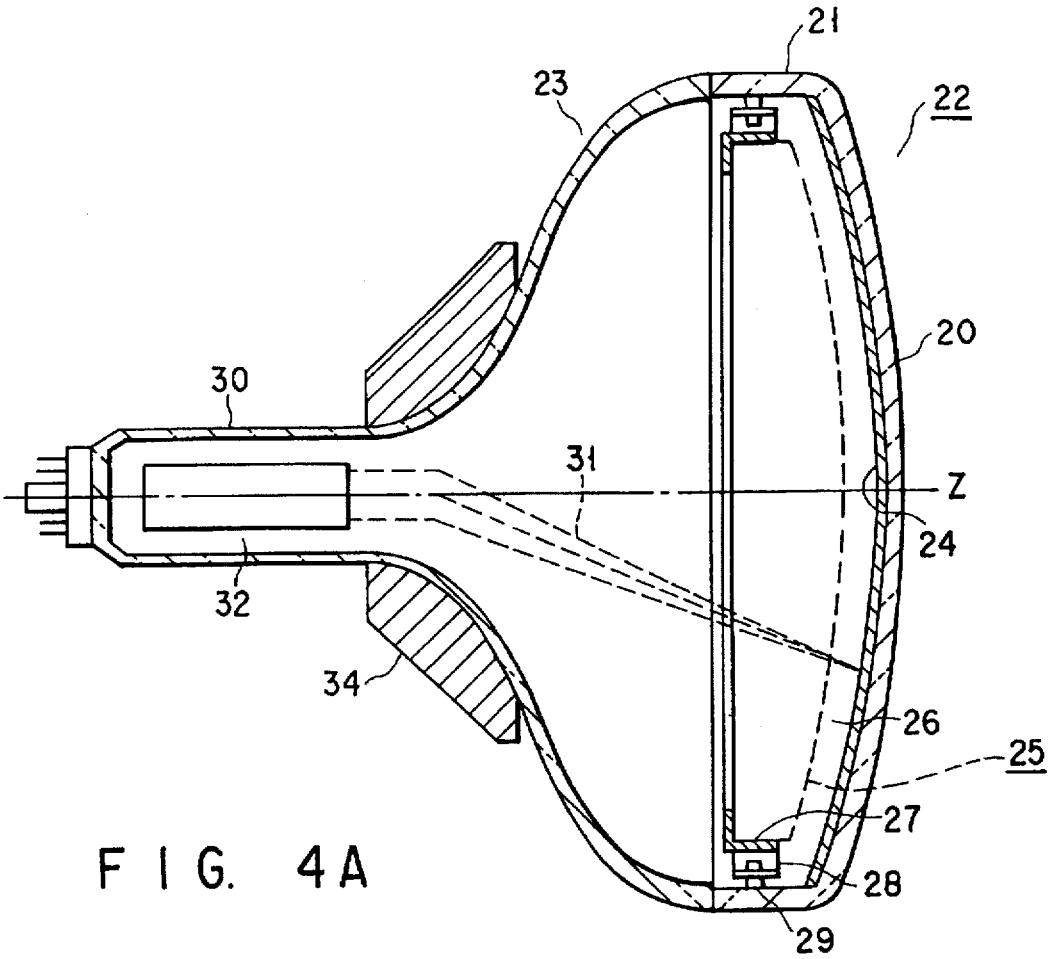
FIG. 4A is a plane view schematically showing the structure of a panel of a color cathode ray tube of one embodiment of the present invention.

FIG. 4 shows a color cathode ray tube of one embodiment of the present invention. The color cathode ray tube of this embodiment comprises an envelope having a panel 22 in which a skirt portion 21 is formed on a peripheral portion of a substantially rectangular effective portion 20 whose inner and outer surfaces are formed of curved surfaces to be described later, and a funnel 23 connected to the skirt portion 21 of the panel 22 as a one unit. On the inner surface formed of the curved surface of the effective portion 20 of the panel 22, there is formed a fluorescent screen 24 in which stripe-shaped three color fluorescent layers for emitting blue, green and red colors are formed in a predetermined array. Then, a shadow mask 25 is mounted onto the inner side opposite the fluorescent screen 24. The shadow mask 25 comprises a mask body 26 and a mask frame 27 whose cross section is L-shaped. In the mask body 26, a skirt portion is formed on the peripheral portion of substantially a rectangular effective surface having a large number of electron beam apertures in the curved surface having a shape corresponding to the inner surface of the effective portion 20 of the panel 22. The mask frame 27 is fixed to the skirt portion. Then, a plurality of elastic supports 28 are attached to the outer surface of the mask frame 27. Insertion holes formed in the elastic supports 28 are inserted to a plurality of stud pins 29 formed on the inner surface of the skirt portion 21 of the panel 22, respectively. Thereby, the elastic supports 28 are formed on the inner side of the the panel 22. On the other hand, in a neck 30 of the funnel 23, there is provided an electron gun 32 for emitting three electron beams 31 arranged on one line.

Figure 4B:
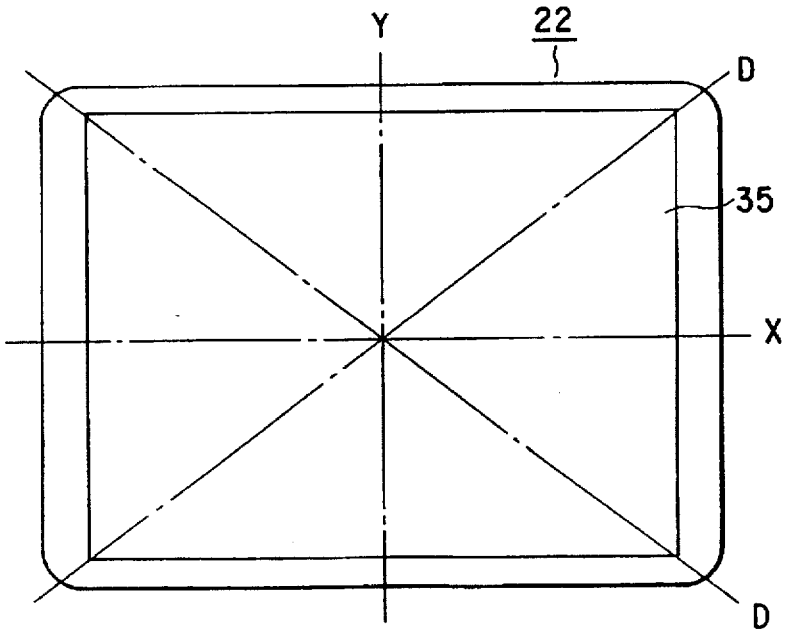
FIG. 4B is a plane view showing an effective surface of the panel of FIG. 4A.

Then, three electron beams 31 emitted from the electron gun 32 are deflected by a magnetic field generated by a deflecting york 34 provided on the outside of the funnel 23. Then, the electron beams 31 are selected by the shadow mask 25 to be horizontally and vertically scanned on the fluorescent screen 24, thereby a color image is displayed on the effective portion 20 of the panel 22. Reference numeral 35 of FIG. 4B shows an image display area of the color image.

Figure 4C:
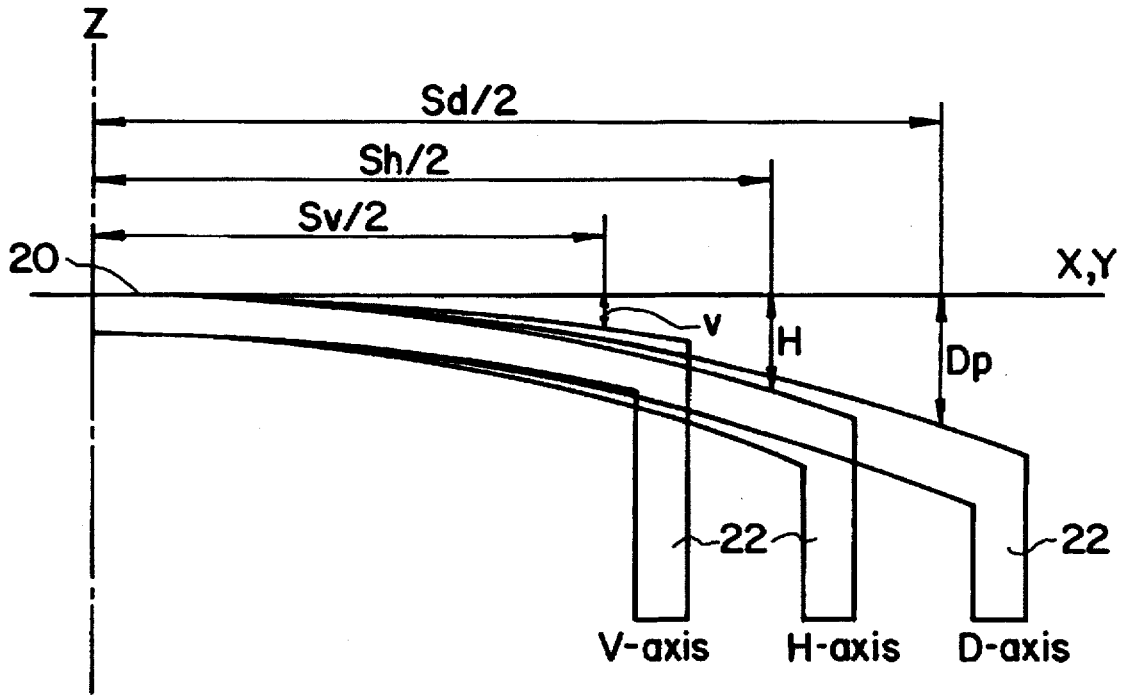
FIG. 4C is a partial cross sectional view of the panel of FIG. 4A.

The outer surface of the effective portion 20 of the panel 22 is substantially spherical. When an effective diameter of a diagonal axis (axis D) of the outer surface of the effective portion 20 is Sd' (mm) and an amount of the height or length in a tube axial (axis Z) direction at the effective ends of the diagonal axis of the outer surface of the effective portion 20 against the center of the outer surface of the effective portion 20 of the panel is Dp (mm), as shown in FIG. 4C there can be obtained flatness to establish the following inequality.

$$Dp/Sd<0.05$$

Moreover, when an amount of drop in the tube axial direction at the effective ends of the long axis (horizontal axis) (axis X) is H (mm), and an amount of drop in the tube axial direction at the effective ends of the short axis (vertical axis) (axis Y), the following inequality can be established.

$$V<H<Dp$$

$$2V<Dp<2H.$$

In other words, the outer surface of the effective portion 20 of the panel 22 is largely flattened, and the image projection appears natural on an area outside of the the effective portion 22 without a sense of incompatibility.

In the panel 22 having such an outer surface, a viewing angle of the peripheral portion is improved, and an apparent image distortion depending on an angle of view can be improved. Moreover, an undesirable angle of view of light internally incident on the panel can be reduced. As a result, definition of the display image can be improved.

As a specific example, in a panel having diagonal sizes that are 68 cm (29 inches) and 80 cm (32 inches), Table 1 shows a comparison between the panel of this embodiment having the above-mentioned flatness and the conventional panel in the value of Dp/Sd.

TABLE 1

| | Diagonal Size | |
|---|---|---|
| | 68 cm | 80 cm |
| Present Embodiment | 0.036 | 0.041 |
| Prior Art | 0.054 | 0.063 |

Moreover, in a wide color cathode ray tube, which has been recently developed, having an aspect ratio of 16:9, Table 2 shows the value of Dp/Sd of the panel having the above-mentioned flatness.

TABLE 2

| | Dp/sd |
|---|---|
| 56 cm (24 inch) Tube | 0.038 |
| 66 cm (28 inch) Tube | 0.037 |
| 76 cm (32 inch) Tube | 0.038 |
| 86 cm (36 inch) Tube | 0.041 |

Accordingly, if the flatness is provided to the panel to the extent shown in Tables 1 and 2, the panel can be sufficiently flattened to obtain a screen without a sense of incompatibility. It is noted that the flatness of the panel is limited by strength of resistance to atmosphere of the envelope.

On the other hand, the inner surface of the effective portion of the panel is aspherical as expressed by the following equation (1) in a rectangular coordinate system where a long axis crossing on the central axis of the panel (conforming to the tube axial (axis Z)) is an axis X, and a short axis is an axis Y.

$$Z=-\sum_{i=0}^{2}\sum_{j=0}^{2} A_{3i+j}\, x^{2i} y^{2j} \tag{1}$$

wherein A3i+j is a coefficient and A0=0. Z represents the coordinates along the z axis for points on the inner surface of the effective portion of the panel.

Table 3 shows a specific numeral value of the coefficient, A3i+j, of equation (1) in a panel whose diagonal size is 68 cm.

TABLE 3

| | Inner Surface | Outer Surface |
|---|---|---|
| A1 | $0.208846 \times 10^{-3}$ | $0.2057 \times 10^{-3}$ |
| A2 | 0 | $0.81507 \times 10^{-9}$ |
| A3 | $0.2057 \times 10^{-3}$ | $0.28033 \times 10^{-3}$ |
| A4 | $0.109302 \times 10^{-9}$ | $0.21949 \times 10^{-8}$ |
| A5 | 0 | $-0.43742 \times 10^{-13}$ |
| A6 | 0 | $0.67972 \times 10^{-9}$ |
| A7 | $-0.323794 \times 10^{-15}$ | $-0.43511 \times 10^{-13}$ |
| A8 | $0.590196 \times 10^{-20}$ | $0.58468 \times 10^{-18}$ |

Figure 5A:
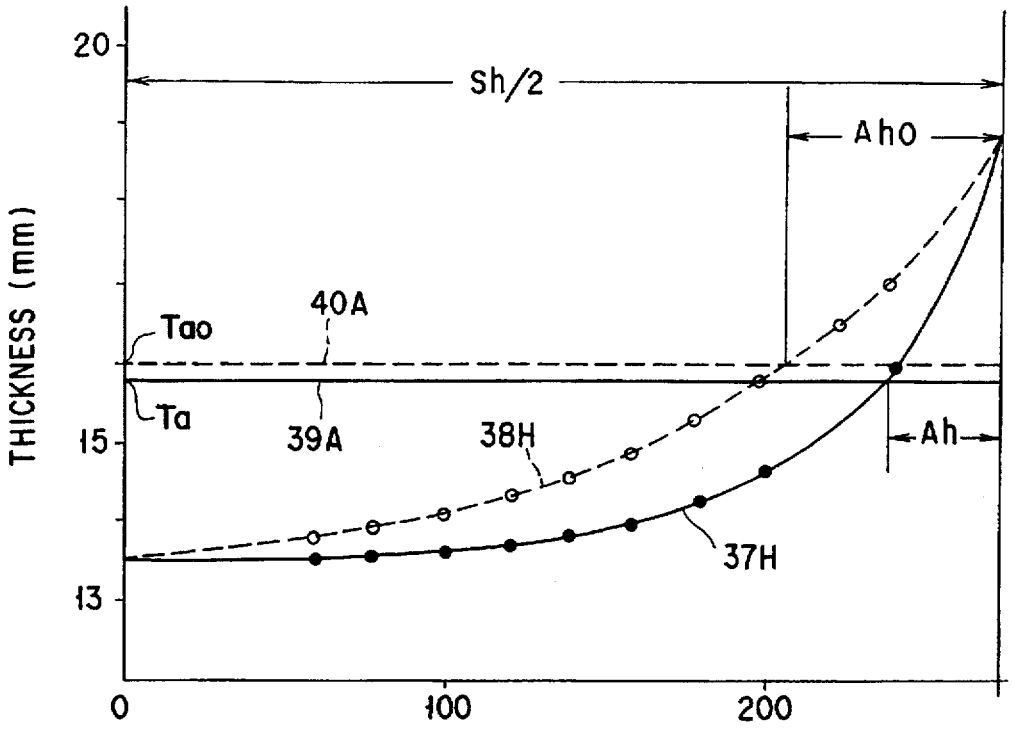
FIG. 5A is a view showing a comparison between the present invention and the prior art in a thickness distribution on a long axis in the effective portion of the panel of the color cathode ray tube.
Figure 5B:
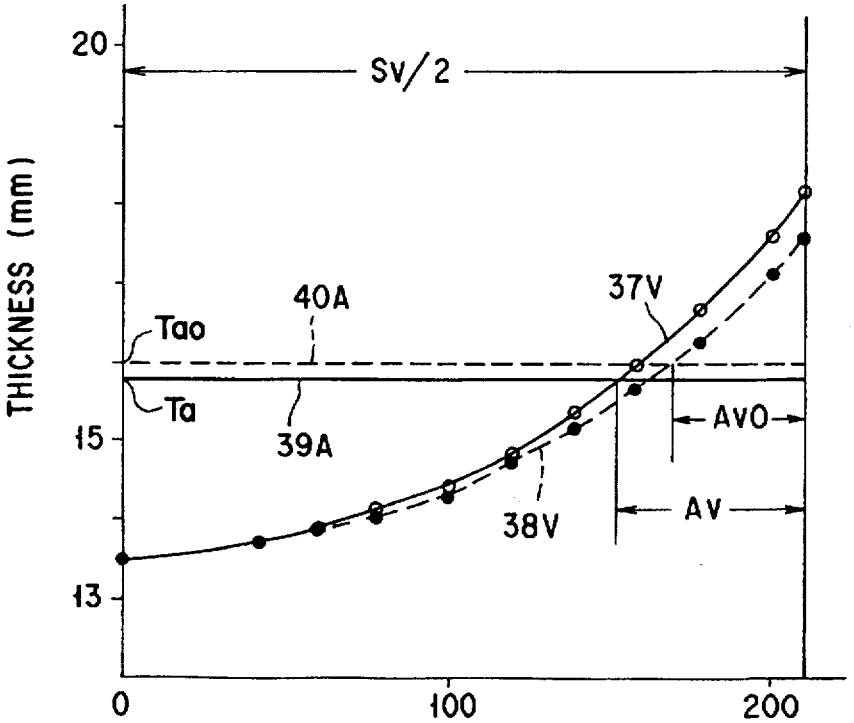
FIG. 5B is a view showing a comparison between the present invention and the prior art in a thickness distribution on a short axis in the effective portion of the panel of the color cathode ray tube.

Moreover, in the panel whose diagonal size is 68 cm, FIGS. 5A and 5B show the comparison between the conventional panel and the panel of this embodiment in the distribution of the thickness on each of the long axis and the short axis, respectively. In the figures, curve lines 37H and 37V shows the distribution of the thickness on the long axis and the short axis of the panel of this embodiment, respectively, and curve lines 38H and 38V shows the distribution of the thickness on the long axis and the short axis of the conventional panel, respectively. As is obvious from the curve lines 37H and 38H of FIG. 5A, the distribution of the thickness on the long axis of the panel of this embodiment is thinner than that of the conventional panel at an intermediate portion in the direction of the long axis. On the other hand, as is obvious from the curve lines 37V and 38V of FIG. 5B, the distribution of the thickness on the short axis of the panel of this embodiment is thicker than that of the conventional panel at a peripheral portion in the direction of the short axis.

More specifically, in the conventional panel, if the effective diameter of the long axis of the effective portion is Sh and that of the short axis is Sv, the distance of the long axial direction of a thicker region on the long axis is Ah0, and the distance of the thicker region on the short axis is Av0, wherein, in the thicker region, the panel has a thickness larger khan the average thickness Ta0. The relationship between Sh, Sv, Ah0 and Av0 can be shown as follow.

$$(Ah0/Sh)>(Av0/Sv)$$

In the panel of this embodiment, effective diameter of the long axis of the effective portion is Sh and the that of the short axis is Sv, the distance of the long axial direction of a thicker region on the long axis is Ah, and the distance of the thicker region on the short axis is Av, wherein, in the thicker region, the panel has a thickness larger than the average thickness Ta. The relationship between Sh, Sv, Ah and Av can be shown as follow.

$$(Ah/Sh)<(Av/Sv)$$

The maximum thickness T max of the panel exists at the corner portion in both the conventional panel and the panel of this embodiment. In the conventional panel, the maximum thickness T max is 17.85 mm, and in the panel of this embodiment, the maximum thickness T max is 18.39 mm. The minimum thickness T min of the panel exists at the central portion of the panel in both the conventional panel and the panel of this embodiment. Then, the relationship between the maximum thickness T max, the minimum thickness T min and the average thicknesses Ta0 and Ta can be shown as follows.

In the case of the conventional panel, $$(T\ max-Ta0)<(Ta0-T\ min)$$

or, $$|T\ max-Ta0|<|T\ min-Ta0|$$

In the case of the panel of this embodiment, $$(T\ max-Ta)>(Ta-T\ min)$$

or, $$|max-Ta|>|T\ min-Ta|.$$

If the panel 22 is formed to have the above-mentioned shape, the portion thicker than the average thickness Ta is reduced in the vicinity of the long axis, and the portion thicker than the average thickness Ta is increased in the vicinity of the short axis in spite of the fact that the outer surface of the effective portion 20 is substantially spherical. Moreover, since the maximum thickness T max exists at the corner portion, the thickness of the intermediate portion of the long axis becomes thin, and the thickness of the long side portion of the short axis end portion becomes thick. As a result, a radius of curvature of the short axial direction Can be largely reduced at the intermediate portion of the long axis of the inner surface of the effective portion 20. For example, in the case of the panel whose diagonal size is 68 cm, the radius of curvature of the short axial direction of the intermediate portion of the long axis is about 1900 mm in the convention panel. In the panel of this embodiment, the radius curvature can be reduced to about 1600 mm.

Moreover, in the panel 22 of this embodiment, since the difference between the average thickness Ta and the maximum thickness T max is large, the thickness is largely changed at the peripheral portion. Particularly, since the thickness is largely increased in the vicinity of the long axial end, the radius of curvature of the long axial direction of the inner surface of the effective portion 20 can be largely reduced. For example, in the case of the panel whose diagonal size is 68 cm, the radius of curvature of the long axial direction of the intermediate portion of the long axis IS about 1900 mm in the convention panel. In the-panel of this embodiment, the radius curvature can be reduced to about 900 mm.

Furthermore, if the panel 22 is structured as mentioned above, the curved surface of the shadow mask approximating the inner surface of the effective portion of the panel must be formed since the distance between the shadow mask and the inner surface of the effective portion of the panel must be generally set to a predetermined value over the entire surface of the effective surface of the mask body. Therefore, if the radius curvature of the inner surface of the effective portion 20 of the panel 22 is reduced, the radius curvature of the effective surface of the mask body 26 placed at the corresponding position is also reduced. As a result, mislanding of the electron beams caused by the thermal expansion of the shadow mask can be effectively prevented. In other words, in the conventional shadow mask, mislanding of the electron beams caused by the thermal expansion was largely generated in the vicinity of the intermediate portion of the long axis. As a means for controlling the thermal expansion of the shadow mask, it is most useful to reduce the radius of curvature of the short axial direction in the vicinity of the intermediate portion of the long axis. Due to this, if the radius of curvature of the inner surface of the effective portion 20 of the panel 22 is reduced, the radius of curvature of the effective surface of the mask body 26 of the shadow mask 25 is also reduced in accordance with the reduction of the radius of curvature of the inner surface of the effective portion 20. As a result, mislanding of the electron beams caused by the thermal expansion of the shadow mask can be effectively prevented.

Moreover, in general, the mechanical strength of the shadow mask is weakest in the vicinity of the long axial end portion. In order to improve such mechanical strength, it is most useful to reduce the radius of curvature of the long axial direction in the vicinity of the intermediate portion of the long axis. Therefore, if the radius curvature of the the effective surface of the mask body 26 is reduced, the mechanical strength in the vicinity of the long axial end portion can be improved.

In the case where the panel whose diagonal size is 68 cm is structured as mentioned above, mislanding caused by the thermal expansion of the shadow mask can be reduced by about 10% in the conventional color cathode ray tube, and the mechanical strength can be doubled. As a result, mislanding caused by the thermal expansion can be largely improved, and degradation of color purity caused by vibration and impact can be largely improved.

Moreover, in the panel 22 of this embodiment, the thickness of the effective portion 20 in the vicinity of the long axial intermediate portion is thinner than the thickness in the conventional panel. Due to this, in the panel 22, the thickness of the short axial end portion becomes thick. However, the average thickness of the panel can be made smaller than that of the conventional panel, and the weight of the panel can be also reduced.

In summary, in spite of the fact that the outer surface of the effective portion 20 is substantially spherical, if the panel 22 is formed to have the abovementioned shape, mislanding caused by the thermal expansion can be largely improved without wasting the mechanical strength of the panel, and degradation of color purity caused by vibration and impact can be largely improved.

The above embodiment explained the color cathode ray tube in which the belt-like elastic support is attached to the central portion of each side of the mask frame to support the shadow mask. However, the present invention may be applied to the color cathode ray tube in which the wedge-shaped elastic support is attached to the corner portions of the mask frame to support the shadow mask.

According to the invention, even in substantially a spherical panel in which the outer surface of the panel can be flattened and an ambient image is naturally reflected, the radius of curvature of the inner surface of the panel and that of the long axial direction is reduced at the long axis peripheral portion of the effective surface of the shadow mask are reduced and the thermal expansion caused by the collision of the electron beams is controlled so that the mislanding of the electron beams can be reduced and the degradation of the color purity can be largely improved. Furthermore, the curved surface, which is mechanically strong, can be formed, and the color cathode ray tube, which can display an image having high definition, can be provided.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode ray tube apparatus comprising:

means for generating electron beams;

a fluorescent screen, on which electron beams are landed;

a shadow mask opposing said fluorescent screen and having a curved surface with a large number of apertures defined therein such that said electron beams are selectively landed on said fluorescent screen after passing through said apertures; and a panel having inner and outer curved surfaces, said fluorescent screen being disposed on said inner surface, said panel having a substantially rectangular effective portion having a short axis Sv, a long axis Sh; and a diagonal axis Sd, wherein said panel has a shape that satisfies the following relationship:

$$Dp/Sd<0.05,$$

$$V<H<Dp,$$

and $$2V<Dp<2H,$$

where Dp=an amount of drop in a tube axial direction at an end of an effective diameter of said diagonal axis of said panel against a center of said outer surface of said effective portion, H=an amount of drop in said tube axial direction at an end of effective diameter of said long axis, and V=an amount of drop in said tube axial direction at said end of an effective diameter of said short axis, wherein a thickness of said effective portion of said panel differs so as to satisfy the following relationship:

$$(Ah/Sh)<(Av/Sv)$$

where Ah=a distance in a long axial direction of a first thickness region on said long axis and Av=a distance in a short axial direction of a second thickness region on said short axis, wherein, in said first and said second thickness regions, said panel has a thickness larger than an average thickness Ta of said effective portion; and wherein a maximum thickness T max of said effective portion in a vicinity of said end of said diagonal axis of said panel satisfies the following relationship $$(T\ max-Ta)>(Ta-T\ min)$$

or, $$|T\ max-Ta|>|T\ min-Ta|,$$

where T min=a minimum thickness of said panel.

2. The apparatus according to claim 1, wherein said inner surface of said effective portion of said panel is aspherical as expressed by the following equation in a rectangular coordinate system, where a long axis crossing a central axis of said panel, conforming to a tube axis Z, is an X axis, and a short axis is a Y axis $$Z=-\sum_{i=0}^{2}\sum_{j=0}^{2}A_{3i+j}x^{2i}y^{2j}$$

wherein A3i+j is a coefficient and A0=0, and wherein Z represents coordinates along said tube axis Z for points on said inner surface of said effective portion of said panel.

* * * * *